United States Patent [19]

Cordova

[11] 4,237,459

[45] Dec. 2, 1980

[54] VISUAL DISPLAY WITH ILLUMINABLE ELEMENTS ARRANGED IN VERTICALLY ALIGNED SECTIONS

[75] Inventor: James Cordova, Burlingame, Calif.

[73] Assignee: Eric F. Burtis, Menlo Park, Calif.

[21] Appl. No.: 972,017

[22] Filed: Dec. 21, 1978

[51] Int. Cl.[3] ..... G09F 9/32

[52] U.S. Cl. ..... 340/756; 340/758; 340/790; 340/760

[58] Field of Search ..... 340/756–765, 340/790, 743

[56] References Cited

U.S. PATENT DOCUMENTS

| | | | |
|---|---|---|---|
| 2,203,630 | 6/1940 | Keen | 340/760 |
| 2,917,733 | 12/1959 | Justus | 340/756 |
| 3,106,696 | 10/1963 | Foley | 340/756 |
| 3,335,416 | 8/1967 | Hughes | 340/743 |
| 3,872,463 | 3/1975 | Lapeyre | 340/761 |

*Primary Examiner*—Marshall M. Curtis

*Attorney, Agent, or Firm*—Fulwider, Patton, Rieber, Lee & Utecht

[57] ABSTRACT

An electronically operated character display having discrete and separate illuminable elements is divided into upper, central and lower sections, each section having a plurality of illuminable elements. The elements are actuated in response to electronic codes corresponding to alphabet characters. Codes for lower case characters having ascending portions enable combinations of illuminable elements in the central and upper sections of the character display. Code for lower case characters having descending portions actuate combinations of elements in the central and lower sections, while codes for lower case characters having neither ascenders or descenders actuate combinations of elements in the central section.

12 Claims, 12 Drawing Figures

VISUAL DISPLAY WITH ILLUMINABLE ELEMENTS ARRANGED IN VERTICALLY ALIGNED SECTIONS

BACKGROUND OF THE INVENTION

1. Field of the Invention

The present invention relates to electronically actuated luminescent displays in which the images of alphabetic characters are produced in response to electronic codes.

2. Description of the Prior Art

In the past, various types of luminescent displays for imaging alphabetic characters have been commercially available. In many commercial devices, such as electronic calculators and the like, the output displays are formed by multiple character, plural segment arrays of light emitting diodes. In a simple character display, seven of such diodes are arranged generally in the form of the numeral "8". Selected combinations of these light emitting diodes can be actuated at each character position to provide a visual output of a sequence of characters. Such a seven segment display is quite adequate for imaging arabic numeral characters, but is incapable of providing images of alphabetic characters due to an inability to provide a recognizable pattern of illumination associated with each character.

Because of the relative complexity in the display of alphabet characters, as opposed to arabic numerals, more complex display arrangements have been necessary for this purpose. For example, in a conventional dot matrix display a plurality of contiguous electrically energizable light emitting elements are provided in closely packed ordered arrangement, usually a rectilinear matrix. These elements may be light emitting diodes, vacuum tube electrodes, and other types of luminescent devices. When energized in appropriate patterns, these light emitting elements can be used to form images of both upper and lower case alphabet characters.

One commercially available dot matrix display device is marketed by ISE Electronics Corp. as the Noritake "itron" type DC 165A2 Display. This display is a dot matrix display 16 characters in length. The character positions are sequentially addressed in time multiplexed arrangement. This particular display, like many commercial devices, has connections for a segment driver system responsive to a standard ASCII code for upper and lower case characters and symbols. Each character is comprised of a rectangular matrix seven dots in height and five dots in width, for a total of 35 dots. The overall height of the seven dots is seven millimeters from bottom to top. This particular device employs gas fluorescent luminescent elements. Like many commercially available dot matrix displays, this device is capable of imaging only numbers and upper case English language alphabet characters without producing significant distortions. When lower case characters are imaged there are severe distortions, both in the image of the lower case characters themselves, and also in the relative vertical alignment of lower case characters with respect to other characters in the display. This may be attributed to the loss of resolution that accompanies the display of lower case characters because of the horizontal rows of dots that are unavailable to display the main bodies of letters, but which must instead be used to image ascenders and descenders.

The problem that arises with this and other conventional displays in imaging lower case characters stems principally from the fact that unlike upper case English language alphabet characters, lower case letters are not correctly depicted as being of uniform height. That is, some lower case letters such as the letters "g", "p" and "q" include descending portions. These letters, when correctly depicted, include portions which extend below a base line above which the main bodies of all alphabet characters, both upper and lower case, are positioned. Similarly, other lower case alphabet characters, such as the letters "f", "l" and "t", and all upper case letters, include ascending portions which rise vertically above an area encompassing the main body of all lower case English language alphabet letters. Still other lower case letters, such as "a", "c" and "x" lie entirely within the vertical confines of an area having its lower limit at the imaging base line and extending upward only a portion of the overall height of capital letters and lower case letters having ascending portions.

Ideally, all lower case English language alphabet characters should be positioned and aligned directly atop a straight, horizontal base line. When these lower case letters appear side by side, as occurs in displaying images of words, the descending portions of letters having descenders should extend below the base line. Ascending portions of letters having ascenders should extend above the main body area common to all lower case letters. This main body area begins at the baseline and extends upward between about 50% and about 60% of the maximum letter height. In practice, however, conventional displays have been unable to correctly produce images of lower case letters in proper horizontal alignment without an unduly large and complex display. No 5 by 7 dot matrix display has heretofore existed which will acceptably display lower case letters.

In the Motorola Memory Data Book, published by Motorola Corporation, 1977, pages 3-27 through 3-40, a rather complex display format is described. The characters are actually displayed within a 7 by 9 rectilinear dot matrix framework. However, a character display 16 bits in height is required to properly position lower case letters. With this 7 by 16 dot display, a seven by 9 dot rectilinear portion is actuated in response to a standard ASCII code, and is shifted a specified number of rows within the seven by sixteen dot matrix. This achieves proper positioning of the lower case characters, but only with additional ROM capacity to perform the necessary shifting and then only with the oversize display matrix. Furthermore, the inordinately great height of the dot matrix required (7 by 16) prohibits the use of such a display within many compact electronic instrumentation packages.

A very similar type of display system is described in connection with the National Semiconductor DM8678 bipolar character generator, appearing on pages 9-22 to 9-31 of the Digital Data Handbook, published by National Semiconductor Corporation, 1977. This arrangement contemplates a visual CRT display in either a 7 by 9 or 5 by 7 character font matrix. As with the Motorola system, the 5 by 7 or 7 by 9 font is shifted several rows for lower case characters having descenders. Also, in the 5 by 7 matrix the characters produced are distorted because the ascenders and descenders have been made too short in order to maximize the detail of resolution in the body portion of the character. For example, the lower case letters "g" and "y" are quite distorted.

All of the conventional character displays heretofore available have severe limitations in providing images of lower case English language letter characters. The character displays of conventional five by seven and seven by nine dot matrix displays have poor resolution. This defficiency in resolution arises because a dot density which is sufficient to image an upper case character that extends the entire height of the display format is insufficient to provide the greater detail required in lower case characters in the area immediately above the base line. The alternative systems which provide a larger matrix have severe cost penalties both in the intricacy of the display construction, and in the display driving address system. In contrast to 35 pinouts, which are all that are necessary to provide a five by seven dot matrix display, an increased number of pinouts are required to accomodate the additional rows of dots through which lower case characters with descenders are shifted.

As an alternative to dot matrix displays, configured types of displays can also be employed to provide images of letters. The electrodes of gas discharge displays, for example, can be configured to improve resolution in the display of lower case characters. That is, electrodes immediately above the character base line are provided in a greater density and with more precise geometry than can be achieved with conventional dot matrix display systems. However, gas discharge displays which have heretofore been constructed in this manner are highly specialized displays and cost considerably more than dot matrix displays.

SUMMARY OF THE INVENTION

A principal object of the present invention is to provide a dot matrix display which can be utilized to image lower case alphabet characters of differing heights with good resolution, but without the larger matrix and display complexity that is heretofore attended improvements in resolution. This is achieved by using a dot display having a rectilinear matrix which is formed with vertically aligned upper, central and lower sections. There are a large number of separately addressable luminescent elements in the central section so that the body of the character immediately above the base line is imaged with a high degree of resolution. In contrast, simplicity is achieved in the upper and lower sections by providing luminescent elements only at those locations necessary to display ascenders and descenders of lower case letters. Moreover, simplicity of actuation is achieved by connection of certain of the luminescent elements for enablement in tandem, especially in the upper and lower sections. As a consequence, the overall matrix height of the character display is only slightly greater than a conventional 7 by 9 low resolution display. Incident to this slight increase in height is a pronounced increase in resolution, but with no increase in matrix size or addressing complexity. Indeed, a dot matrix display according to the present invention can be addressed to image lower case characters without increasing at all the number of pin outs from a conventional 5 by 7 matrix. The number of pin outs is less than a conventional 7 by 9 character font display matrix.

A further object of the invention is to provide a character display that is responsive to standard ASCII code format. The segment drive system for the luminescent elements responds directly to an ASCII code input, which may or may not involve augmentation to create a seven bit code, depending upon whether or not the ASCII character is originally expressed in compressed ASCII code.

A further object of the invention is to achieve a proper alignment of lower case characters in an imaged display relative to a common base line, without requiring a row shifting code conversion input. Indeed, as previously noted, the input to the character display of the present invention is a standard ASCII code input which requires no augmentation for shifting information. Characters are not shifted within the rectilinear luminscent element arrangement of the invention, so that no oversize matrix display is required.

The invention may be illustrated with greater clarity and particularly by reference to the accompanying drawings.

DESCRIPTION OF THE DRAWINGS

FIG. 8 is a side sectional view taken along the lines 8—8 of FIG. 3.

DESCRIPTION OF THE EMBODIMENTS

Figure 1:
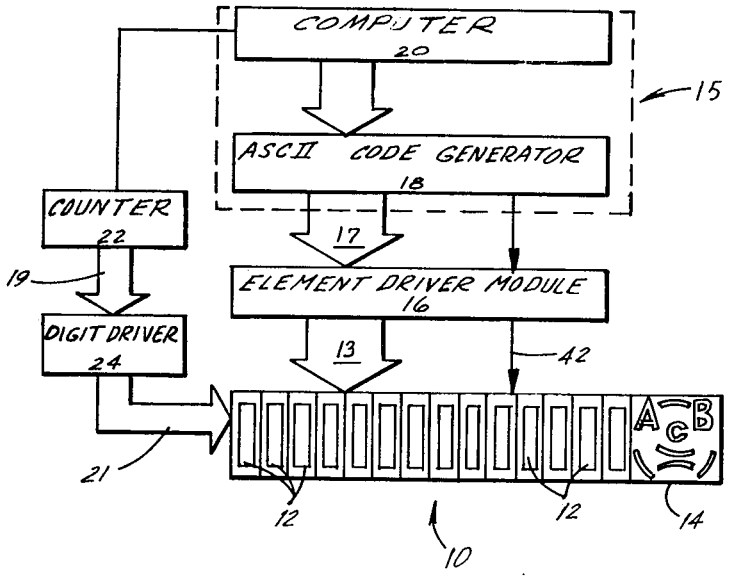
FIG. 1 is a block diagram of the addressing and enabling system of the display of the invention.

With reference to FIG. 1, an electronically actuated illuminated visual vacuum fluorescent display 10 is provided and has a character field of 14 horizontally spaced character matrices 12. At the extreme righthand end of the display 10 there is a symbol 14, depicted in detail in FIG. 9. Illuminable elements in each of the character matrices 12 are driven on lines 13 by element drivers encompassed within a driver module 16. The driver module 16 in return responds to standard ASCII codes generated by an ASCII code generator 18 and transmitted on lines 17.

One device contemplated in which the display 10 is used to advantage is a machine for teaching language and grammar skills. In applications such as these, it may well be that only lower case letters are required, so that a computer 20 is utilized to generate character codes which are compressed ASCII codes, each five bits in width. The functions of the computer 20 and ASCII code generator 18 may be performed internally within a microprocessor 15. The computer 20 also drives a one of fifteen counter 22 which in turn has fifteen output lines 19 connected to a digit driver unit 24. The counter 22 and digit driver 24 sequentially power electrodes that gate illuminating signals at each of the character font matrices 12 and the symbol 14 by actuation on one of fifteen lines 21.

Figure 2A:
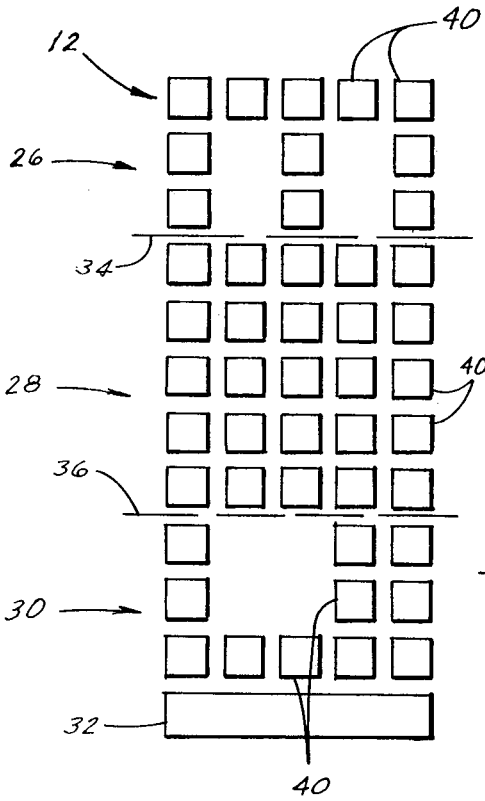
FIG. 2*a* is a detailed view of the matrix arrangement for luminescent elements for one embodiment of the display of the invention.
Figure 2B:
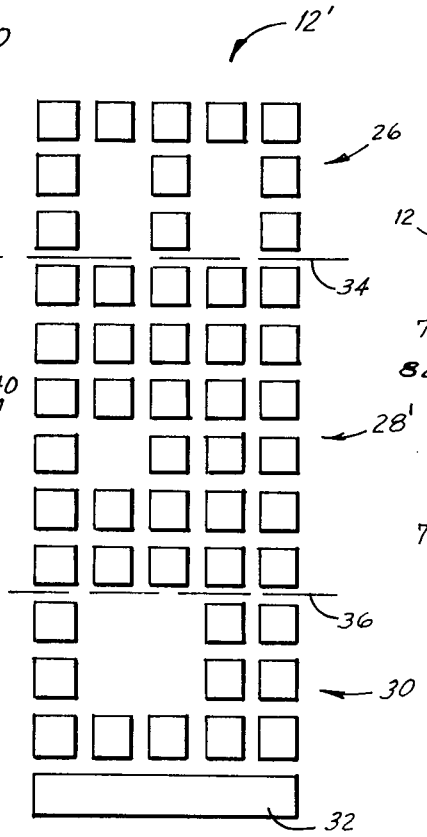
FIG. 2*b* is an alternative embodiment of the character display matrix.

One embodiment of the dot array employed within each of the positions of the character font matrices 12 is depicted in FIG. 2*a*. It should be noted that the dot elements, which are depicted as squares, are divided into an upper section 26, a central section 28 and a lower section 30. In addition, a cursor bar 32 is provided below the lower section 30 to be illuminated as an underline when desired. The upper section 26 and central section 28 are divided by an imaginary line 34 which is a demarkation between the upper limits of those lower case letters that have ascenders, such as "b" and "d" and those letters which do not, such as "e" and "p". Similarily, an imaginary line 36 is indicated between the central section 28 and the lower section 30 of matrix 12 as defining the base line below which only those lower case letters having descenders, such as "j" and "y" depend. Similar demarkations and sections are indicated in the embodiment of FIG. 2*b*. It should be noted that the central section 28 of FIG. 2*a* is 5 elements 40 high and five elements 40 wide, while central section 28' of FIG. 2*b* is 6 elements 40 high and 5 elements wide.

In both the embodiments of FIG. 2*a* and FIG. 2*b* the individual illuminable elements 40, are arranged in a rectilinear matrix in vertical columns and horizontal rows within each column. The convention used in referring to these columns and rows is to consider the left most column as the first column, the next adjacent column to the right is the second column, and so forth. It can be seen that there are a total of five columns. Also, the first row is considered to be the uppermost row in each section, the second row, the next row below the uppermost row, and the third row as being the third row proceeding downward, and so forth. It can be seen that there are three rows in the upper section 26, five rows in central section 28 in FIG. 2*a* and six rows in central section 28' in FIG. 2*b*. Lower section 30 has three rows in both FIGS. 2*a* and 2*b*.

Figure 4:
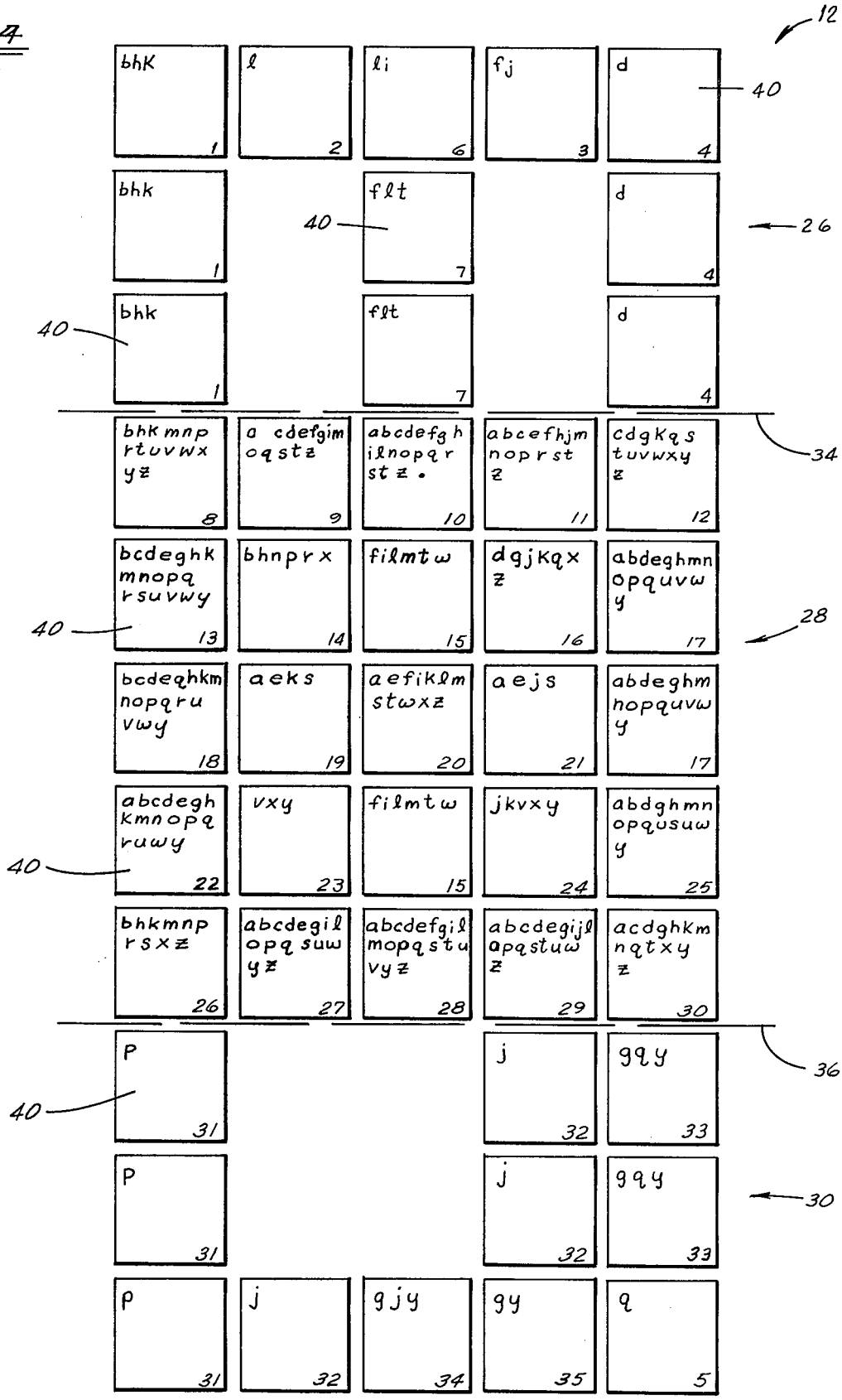
FIG. 4 is a chart illustrating the ASCII code response and tandem connections of the character display matrix of the embodiment of FIG. 2*a*.
Figure 5:
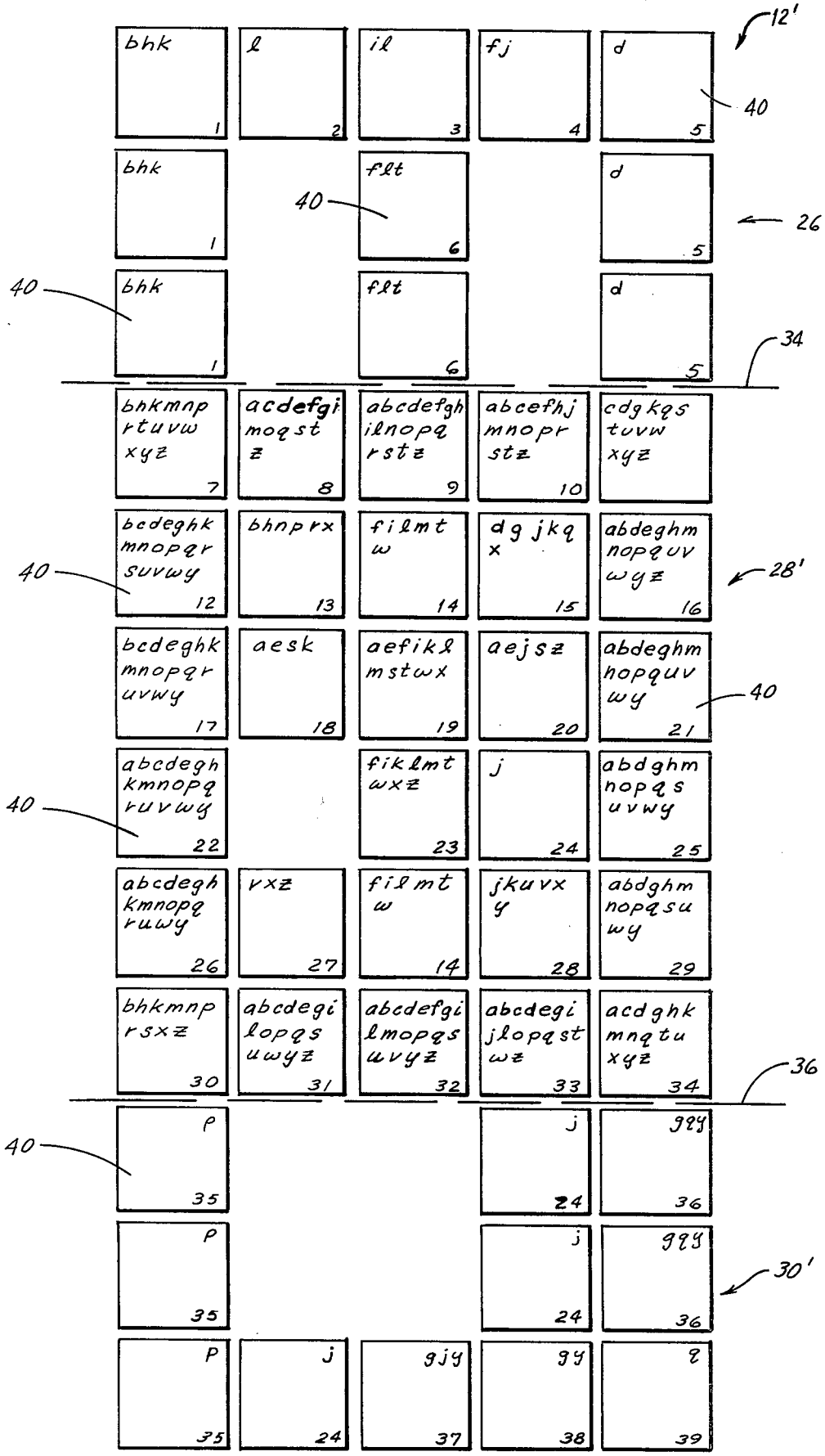
FIG. 5 is a chart of the ASCII code response and tandem connections of the luminescent elements of the embodiment of FIG. 2*b*.

The dot matrices of FIGS. 2*a* and 2*b* are reproduced in enlarged form in FIGS. 4 and 5 respectively.

The luminescent elements 40 in the embodiments of FIGS. 2*a* and 2*b* are numbered in FIGS. 4 and 5. This number corresponds to a pin connection appearance that extends externally from the display 10. It should be noted that several of the luminescent elements 40 bear the same number. This is to indicate that these elements are actually connected in tandem so that they are actuated in parallel by a signal on a single pin connection associated therewith.

The physical structure of the luminescent elements 40 are anodes in an ionizable gas. The elements 40 are contained within an encapsulating envelope. Each element 40 ionizes gas in its immediate vicinity when a driving signal is applied to it. The ionized gas glows to provide a lumininescent dot of light. A biasing signal is provided, in the case of the embodiment of FIG. 2*a*, on one of thirty five lines from the element driver module 16. Each of these lines is connected to a separate one of the pin connections, numbered 1 through 35 in FIG. 2*a*. A separate cursor connection is also driven by the element driver module 16 and is connected to the horizontal cursor bar 32 located below the array of rows and columns of the smaller luminescent elements 40.

While dot matrix displays of the character font arrangements depicted in FIGS. 2*a* and 2*b* are preferably formed from gas fluorescent electrode elements, it is to be understood that various other alternative luminous structures may be utilized. For example, the character font array 12 may be formed of luminescent elements in light emiting diodes, Nixitubes, plasma display tubes, fluorescent display tubes, incandescent lamps, Braun tubes, minature bulbs, liquid crystals, PLZT ceramics, electro ceramics, and light pipes.

Details of the connections for the character font matrix 12 are depicted in FIG. 4. The cursor bar 32 has been omitted from FIG. 4 for the sake of clarity, since the cursor is illuminated by actuation of single dedicated signal drive line 42, as indicated in FIG. 1.

With reference to FIG. 4, it should be noted that the major portions of all of the lower case letters of the English language alphabet appear in the central section 28 of the character font matrix 12. It should also be noted that there is a high degree of resolution of luminescent elements in this 5 by 5 dot matrix section. In this central section 28 there are only two pairs of matrix elements 40 which are coupled together to a common pin. That is, one pair of elements are connected to pin 15 and another pair are connected to pair 17. With these two exceptions, all of the other luminescent elements 40 in the central section 28 are enabled individually by a signal through a dedicated pin connection.

Nevertheless, a total of only 35 pin connections are required for the entire matrix of sections, 26, 28 and 30. This is because many of the luminescent elements 40 located in the upper section 26 and the lower section 30 are operated in tandem. Also, there is indeed no requirement for luminescent elements 40 at some of the matrix positions in the upper section 26 and lower section 30. The illuminable dot elements 40 are arranged in the rectilinear matrix of the character font matrix 12 and are electrically connected for selective enablement in combinations to display visible language characters in response to ASCII character codes from the ASCII code generator 18 of FIG. 1. Luminescent elements 40 are electrically connected only in the first, third and fifth columns of the second and third rows of the upper section 36. That is, elements 40 are omitted from the second and third rows at the first and fourth column positions. Also, luminescent elements 40 are electrically connected only in the first, fourth and fifth columns of the first and second rows of the lower section 30. That is, elements 40 are omitted from the first and second rows at the second and third column positions. The element driver module 16 enables selected combinations of electrodes in the central section 28 and the upper section 26 for illumination in patterns corresponding to lower case alphabetic characters having ascenders, such as the letters "f", "h" and "t". The element driver module 16 enables selected combinations of electrodes forming luminescent elements 40 in the central section 28 and lower section 30 for illumination in patterns corresponding to lower case alphabetic characters having descenders, such as "g", "j" and "y". Other lower case letters, such as the letters "e", "i" and "m" have ASCII codes that act through the element driver module 16 to actuate only electrodes forming luminescent elements 40 within the central section 28.

As previously stated, certain combinations of the luminescent elements 40 are actuated in tandem, especially in the upper section 26 and lower section 30. For example, all of the luminescent elements 40 within the first column of the upper section 26 are enabled or disabled together. As indicated in FIG. 4, these elements will be illuminated for each of the letters b, h and k and are all connected to pin 1 of the display 10. Similarly, the last elements 40 in the first and second rows of the lower section 30 are coupled together for operation in tandem connection to pin 33 of the display 10. Pin 33 will be activated whenever an ASCII code for the letters g, q, or y is received.

Figure 6A:
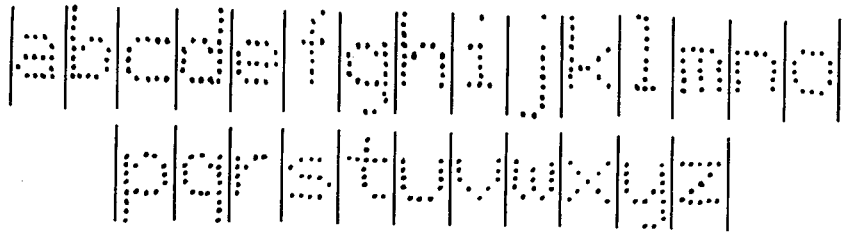
FIG. 6*a* is a diagram illustrating the character images achieved with the display of FIG. 2*a*.

To image a lower case character, several of the pin connections are activated, while the others are not. For example, to produce an image of the letter "y" using the character font matrix of FIGS. 2*a* and 4, enabling signals for the letter "y" in compressed ASCII code are produced in the ASCII code generator 18. This code is transmitted to the element driver module 16 where AND gates respond to the ASCII code for the letter "y" to establish electrical connections to pins 8, 12, 13, 17, 18, 22, 24, 25, 27, 28, 30 33, 34 and 35. When these pins are enabled, a visual image of the letter "y" appears in the activated matrix 12 of the display 10 with the density and proportions of that letter as depicted in FIG. 6*a*.

Figure 6B:
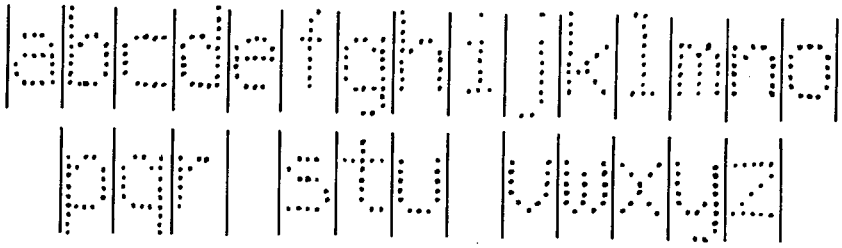
FIG. 6*b* is a diagram illustrating the character images achieved with the display of FIG. 2*b*.

An alternative embodiment to the invention employing the matrix 12 is illustrated at 12' in FIG. 2*b* and is depicted in detail in FIG. 5. The previous explanation as to the matrix organization and structure relating to FIG. 4 is applicable with respect to FIG. 5, with the exception that instead of five horizontal rows of luminescent elements 40 in the central section 28, there are six such rows in the central section 28'. It should be noted that no luminescent dot element 40 is connected in the second column and at the fourth row of the central section 28' in the character font matrix 12' of FIG. 5. In contrast to the embodiment of FIG. 4, there are 51 different luminescent elements 40 in the rectilinear matrix depicted, and 39 unique addressable pin connections. A conventional evacuated glass envelope, suitable for housing a conventional 7 by 9 dot matrix display, can be employed to enclose a display with character format matrices according to FIG. 5. Images of the characters produced with the embodiment of FIG. 5 are illustrated in FIG. 6*b*. The high resolution and proper proportions of the lower case characters as they appear in FIGS. 6*a* and 6*b* utilizing the present invention are equal or superior to prior art systems requiring larger matrices and more complex addressing arrangements.

Figure 7A:
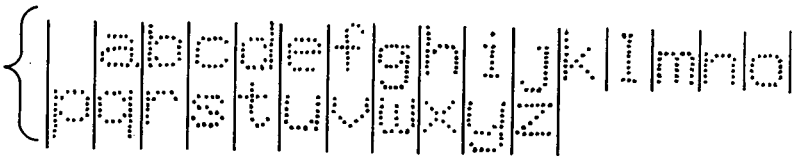
FIG. 7a PRIOR ART
FIG. 7*a* is a diagram illustrating the character images obtained with one prior art device.

FIG. 7*a* depicts the character images achieved with the prior art Motorola system previously described. Certain defects appear in the character images. For example, the image of the character "y" appearing in FIG. 7*a* is generated in a 7 by 9 dot character outline within the 16 low matrix previously described. Although requiring a greater number of pin connections, the image produced in FIG. 7*a* is somewhat inferior to that of the present invention. To illustrate the tail of the letter y is too short as a proportion of the main body of that letter. Also, the resolution of the center of the letter s is also quite poor, in contrast to the images of the letter "s" produced in the present invention, as depicted in FIGS. 6*a* and 6*b*. Furthermore, the letter "j" is inordinately tall and the dot above the stem is misplaced.

Moreover, row shifting is required to produce the images of the letters "g", "j", "p", "q", and "y". A code converter is thereby required in the character generator to perform the row shifting function. In addition, a display to produce the images of FIG. 7*a* requires 63 pin out connections, in contrast to the 35 or 39 connections required by the embodiments of FIGS. 4 and 5 respectively in a display of the present invention.

Figure 7B:
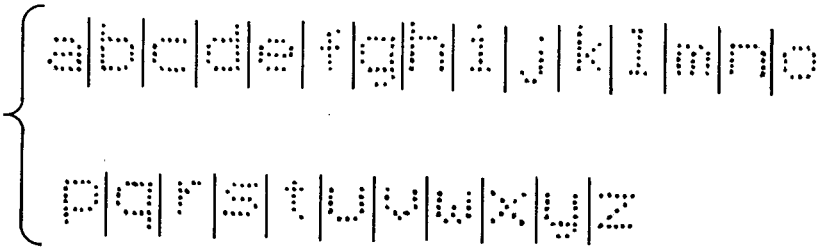
FIG. 7b PRIOR ART
FIG. 7*b* is a diagram illustrating the character images obtained with another prior art device.
Figure 3:
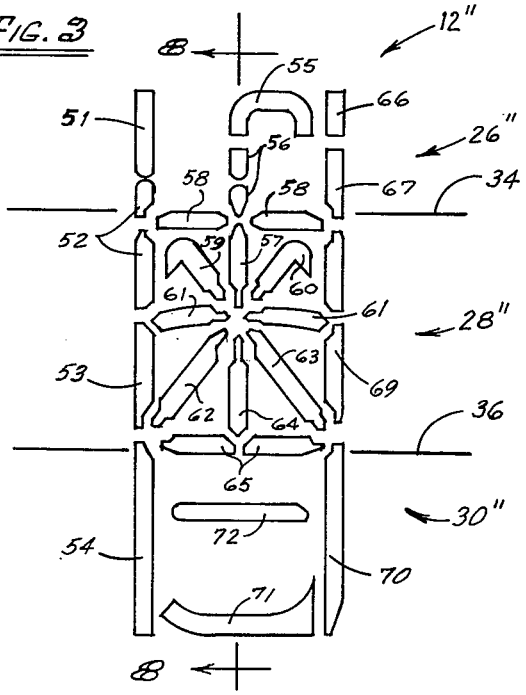

The images achieved utilizing the present invention is also superior to those of another prior art arrangement depicted in FIG. 7*b*. FIG. 7*b* illustrates the images produced in a 5 by 9 rectilinear matrix in a CRT display. Data must be supplied to 63 scanning address positions. Unlike the present invention, images of FIG. 7*b* do not employ the increased density of uniquely addressable matrix locations at the center of the character position just above the base line. As a result, the resolution of the images of the lower case letters is poor. Also, noticeable distortions exist in the images produced. For example, the vertical lines of the letters "b", "d" and "h" are disportionately short compared to the body of those characters. Also, the tail of the letter t is distorted. This is in contrast to the letter images depicted in FIGS. 6*a* and 6*b* produced with the embodiment of the invention of FIGS. 4 and 5 respectively.

Figure 3:
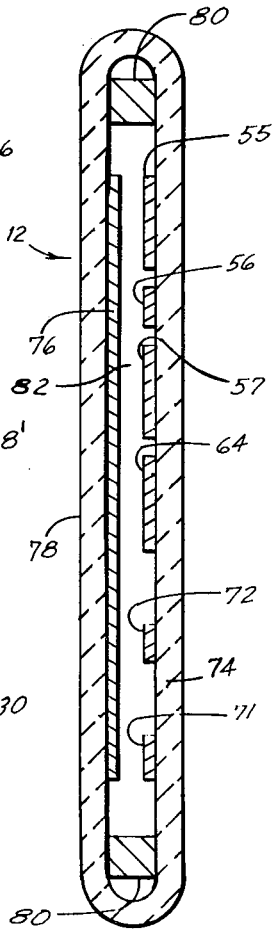
FIG. 3 illustrates an alternative embodiment to the display matrices of FIGS. 2*a* and 2*b*.

Embodiments of the invention are not limited to dot matrix elements. One alternative embodiment, suitable for use only with lower case letters and with arabic numerals, but not with upper case letters, is illustrated in FIG. 3. The display 12" of FIG. 3 is a gas discharge type of display. The configured luminescent actuable gas discharge electrodes are indicated by the identifying reference numerals 51–72, with electrodes which are actuated in tandem bearing a common number. There are a total of 22 pin connections used to enable the gas discharge electrodes 51–72. The electrodes 56, although in vertical alignment, are separated so that a dot for the letter "i" can be produced. The electrodes 52 are used to produce the letter "r". The electrode 72 is used as a cursor to underline characters.

FIG. 8 is a section of the electrode matrix of FIG. 3. As seen in the cross section through the display device 12" shown in FIG. 8, the segment electrodes for the alphabet characters may be deposited on a substrate 74, which, for instance, may be a ceramic plate that carries also the leads or bus bars for interconnecting corresponding electrodes for connection to a common pin.

The electrodes 51–72 are preferably cathode electrodes which interact with a common anode 76. The anode 76 may be deposited on the inside of a glass panel 78 which is spaced from the ceramic plate 74 by spacers 80 which also seal the space between the plates 74 and 78. A charge of ionizable gas is confined in the enclosure 82 between the panels 74 and 78. Actuation of enabled ones of the cathodes 51–72 impart a charge to the ionizable gas immediately adjacent thereto to create a fluorescent illumination in the immediate vicinity. Depending upon the pattern of electrodes enabled, the images of the various lower case letters of the English language alphabet are displayed using the matrix display 12".

Preferably, the overall height of the display matrix 12" is no more than nine millimeters. Preferably also, the height of the lower section 30 is no more than three millimeters and the height of the central section 28 is no more than 4 millimeters, leaving an approximate height of 2 millimeters for the upper section 26.

In the embodiment of the invention depicted in FIG. 4, the height of the central section 28 is preferably about 3.65 millimeters while the height of the upper and lower sections 26 and 30 are each about 2.18 millimeters. With this construction, a fourteen position character display with the symbolic indicator 14 can be positioned in a conventional vacuum envelope which is 28 millimeters high by 100 millimeters long. Such glass envelopes are commercially used to house conventional sixteen character position displays having five by seven rectilinear matrices at each character position.

The lower case letter codes and the corresponding actuated electrodes for the several embodiments of the invention illustrated are set forth below in corresponding fashion in Table I.

| CHARACTER | FIG. 4 Pins Enabled | FIG. 5 Pins Enabled | FIG. 6 Pins Enabled |
|---|---|---|---|
| a | 9,10,14,17,19, 20,21,22,25, 27,28,29,30, | 8,9,10,16 18,19,20,21 22,25,26,29, 31,32,33,34 | 53,58,61,65,68 69 |
| b | 1,8,10,11,13 14,17,18,22,25, 26,27,28,29 | 1,7,9,10,12,13 16,17,21,22,25 26,29,30,31,32,33 | 51,52,53,58 65,68,69 |
| c | 9,10,11,12,13 18,22,27,28,29,30 | 8,9,10,11,12,17,22 26,31,32,33,34 | 52,53,58,65 |
| d | 4,9,10,12,13 16,17,18,22, 25,27,28,29, 30 | 5,8,9,11,12,15 16,17,21,22,25 26,29,31,32,33,34 | 52,53,58,65,66 67,68,69 |
| e | 9,10,11,13,17, 18,19,20,21,22, 27,28, 29 | 8,9,10,12,16, 17,18,19,20,21 22,26,31,32,33 | 52,53,58,61,65, 68 |
| f | 3,7,9,10,11, 15,20,28 | 4,6,8,9,10,14 19,23,32 | 55,56,57,58,64 |
| g | 8,10,12,13, 16,17,18,22 25,27,28,29 30,33,35,34 | 8,9,11,12,15,16 17,21,22,25,26,29 31,32,33,34,36 37,38 | 52,53,58,65, 68,69,70,71 |
| h | 1,8,10,11,13, 14,17,18,22,25 26,30 | 1,7,9,10,12,13,16 17,21,22,25,26,29 30,34 | 51,52,53,58,68 69 |
| i | 6,9,10,15 20,27,28, 29,34 | 3,9,14,19,23 32 | 57,64 |
| j | 3,11,16,21, 24,29,32 | 4,10,15,20,24,28 33,37 | 68,69,70,71 |
| k | 1,8,12,13,16, 18,19,20,22, 24,26,30 | 1,7,11,12,15 17,18,19,22,23 26,28,30,34 | 51,52,53,60, 61,63 |
| l | 2,6,7,10,15, 20,27,28,29 | 2,3,6,9,14,19 23,32 | 51,52,53 |
| m | 8,9,11,13,15 17,18,20,22,25, 26,28,30 | 7,8,10,12,14 16,17,19,21 22,23,25,26,29,30 32,34 | 52,53,57,58 64,68,69 |
| n | 8,10,11,13,17, 18,22,25,26,30 | 7,9,10,12,16,17,21 22,25,26,29,30,34 | 52,53,57,58,64 |
| o | 9,10,11,13,17 18,22,25,27,28 | 8,9,10,12,16,17 21,22,25,26,29, 31,32,33 | 52,53,58,65, 68,69 |
| p | 8,10,11,13,14, 17,18,22,25, 26,27,28,29,31 | 7,9,10,12,13,16 17,21,22,25,26, 30,31,32,33,35 | 52,53,54,58 65,68,69 |
| q | 9,10,12,13, 16,17,18,22, 25,27,28,29 30,33 | 8,9,11,12,15,16, 17,21,22,25,26,29 31,32,33,34,36,39 | 52,53,58,65 68,69,70 |
| r | 8,10,11,13, 14,18,22,26 | 7,9,10,12,13,17,22, 26,30 | 52,53,58 |
| s | 9,10,11,12 13,19,20,21 25,26,27,28 29 | 8,9,10,12,18,19, 20,25,29,30,31,32 33 | 52,58,61,65 69 |
| t | 7,8,9,10,11 12,15,20,28 29,30 | 6,8,9,10,14,19,23, 32 | 56,57,58,64 |
| u | 8,12,13,17,18 22,25,27,28,29 | 7,11,12,16,17,21 22,25,26,28,29,31 32,34 | 52,53,65,68, 69 |
| v | 8,12,13,17, 18,23,24,28 | 7,11,12,16,17,21,22, 25,27,28,32 | 59,60,64 |
| w | 8,12,13,15,17 18,20,22,25 27,29 | 7,11,12,14,16,17,19 21,22,23,25,26,14,29, 31,33 | 52,53,62, 63,68,69 |
| x | 8,12,14,16, 20,23,24,26,30 | 7,11,13,15,19,23,27 28,30,34 | 59,60,62, 63, |
| y | 8,12,13,17 18,22,23,24, 24,27,28,30, 33,34,35, | 7,11,12,16,17,21, 22,25,26,28,29,31,32 34,36,37,38 | 52,53,65,68, 69,70,71 |
| z | 8,9,10,11,12, | 7,8,9,10,11, | 58,60,62,65 |

-continued

| CHARACTER | FIG. 4 Pins Enabled | FIG. 5 Pins Enabled | FIG. 6 Pins Enabled |
|---|---|---|---|
| | 16,20,26,27, 28,29,30 | 16,20,23,27, 30,31,32,33,34 | |

Figure 9:
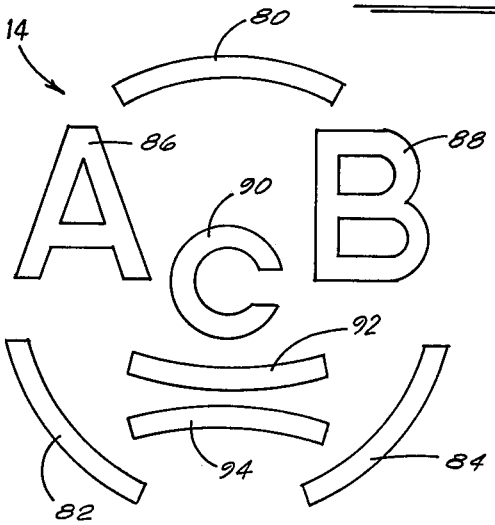
FIG. 9 illustrates an additional luminescent symbol produced as depicted in FIG. 1.

The symbol 14 is depicted in detail in FIG. 9. In the application of the invention contemplated, which is a teaching machine for youthful students learning spelling, grammar and other language arts, it is desirable to have an indicator to show correctness or incorrectness of a particular response. This indicator may be conveniently included in this display 10, and as depicted in FIG. 9, takes the form of a charicature of a face. The symbol 14 may be any of the types of luminescent devices heretofore suggested. The symbol 14 includes three arcuately configured and spaced electrodes 80, 82 and 84. These electrodes are positioned respectively, at a forehead outline, and the opposing cheek outlines of a face. Other electrodes 86 and 88 are provided in the form of a letter "A" and a letter "B". The nose 90 is formed as the letter "c". Mouth electrodes 92 and 94 are provided, to depict, respectively, a smiling and a frowning mouth.

When the symbol 14 is illuminated, the facial outline electrodes and the eyes and nose electrodes are illuminated, along with one of the alternative mouth electrodes 92 or 94. The particular electrode 92 or 94 is determined by the correctness or incorrectness, respectively of a response manually inserted and electronically encoded by a user of the instrument with which the display 10 is employed. Illumination of the symbol 14 with the mouth electrode 92 enabled produces a similing face, while illumination with the mouth electrode 94 lighted produces a frowning face. The symbol 14 may either be enabled to appear to light continuously, or enablement may be at periodic intervals so as to produce a blinking symbolic indication of correctness or incorrectness.

The fourteen character font matrices 12 and the symbol 14 appear to be lighted continuously, but are actually sequentially enabled. In the arrangement depicted in FIG. 1 the computer 20 pulses a one of fifteen counter 22. Fifteen lines emanate from the one of fifteen counter 22 and are indicated collectively at 19. Each of these lines is connected to a position driver in a position driving module 24. The fifteen outputs of the position drivers are indicated collectively at 21 and carry amplified signals on fifteen separate lines. Each line is connected to a particular one of the character font matrices 12 and the symbol 14.

When the counter 22 enables the line associated with a particular character font matrix 12, or the symbol 14, all electrodes to that character font position or symbol are gated. At that time the combinations of signals to the electrodes 40, or the electrodes in the symbol display 14, determine the pattern of illumination at the character position gated. The counter 22 rapidly sequences each of the several matrices 12 and the symbol 14 so that recurrent illumination of electrodes at each character position 12 and symbol 14 simulates a continous display. That is, even though the positions are sequentially gated, the images thereat do not flicker, but instead appear to exhibit a continuous glow.

The invention has a variety of applications, but its unique effects are particularly advantageous in electronic teaching devices for school children in the elementary grades. Not only can the display of the invention be utilized as a means for displaying words and letter combinations to teach a student language skills or to provide a student with messages, but the character images provided help familiarize a student with proper structure and proportions of alphabet characters. Unlike prior simplified displays where the characters provided are only of approximate geometry and at best are merely recognizable, the characters imaged with the display of the present invention form a learning aid in themselves by exposing a student to proper lower case letter structure, geometry and base line positioning. The display of the invention is also flexible enough to display arabic numerals, which are useful in such applications for indicating times, scores, and other numerical information.

Accordingly, the invention should not be construed as limited to the particular embodiments illustrated, but rather is defined in the claims appended hereto.

I claim:

1. In a luminescent display in which individual illuminable elements are located in fixed positions in said display and are electrically connected and arranged in a multipurpose matrix and are coupled to respond directly and concurrently to binary electronic alphabet character codes and are actuable in selected combinations to produce an illuminated display of alphabet characters as specified by said binary electronic alphabet character codes, the improvement wherein said elements are positioned in upper, central and lower vertically aligned sections, each section including a plurality of said elements, and wherein a plurality of elements in each of said upper and lower sections are coupled together for tandem enablement, and said elements in said lower section are responsive only to character codes of alphabet characters having portions descending below a baseline.

2. A display according to claim 1 further characterized in that said elements are discrete electrodes in a gas fluorescent encapsulated structure.

3. In an electronic dot matrix in which individual illuminable dot elements are arranged at fixed positions in a rectilinear matrix and are electrically connected for selective enablement in combinations to display visible images of language characters in direct and concurrent response to binary electronic alphabet character codes, the improvement comprising upper, central and lower dot sections in vertical alignment within said rectilinear matrix, each section including a plurality of contingu- ous dots, and wherein a plurality of dots within each of said upper and lower sections are coupled for enablement in tandem, and said dots in said lower section are responsive only to characters having descenders.

4. The dot matrix display of claim 3 wherein said rectalinear matrix includes five vertical columns of dots and said upper section includes three horizontal rows of dots, said central section includes five horizontal rows of dots and said lower section includes three horizontal rows of dots.

5. The dot matrix display of claim 4 further characterized in that dot elements are electrically connected for actuation in said central section, and in the first row of said upper section and only in the first, third and fifth columns of the second and third rows of said upper section and dot elements are electrically connected in the third row in said lower section, and only in the first, fourth and fifth columns of the first and second rows of said lower sections.

6. The dot matrix display of claim 5 further characterized in that said dot elements are electrically connected for selective enablement in no more than thirty five unique combinations.

7. The dot matrix display of claim 3 wherein said rectalinear matrix includes five vertical columns of dots and said upper section includes three horizontal rows of dots, said central section includes six horizontal rows of dots, and said lower section includes three horizontal rows of dots.

8. The dot matrix display of claim 7 further characterized in that dot elements are electrically connected for actuation in said central section and only in the first row and in the first, third and fifth columns of the second and third rows of said upper section and dot elements are electrically connected in said third row of said lower section and only in the first, fourth and fifth columns of the first and second rows of said lower section and no dot element is connected in the second column at the fourth row of said central section.

9. The dot matrix display of claim 3 further comprising a horizontal luminescent element disposed across said rectilinear matrix adjacent one vertical extremity thereof.

10. An electronically actuated illuminated visual display having a plurality of character positions, each character position comprising at least one electrode of a first polarity and a plurality of luminescent electrodes of opposite polarity arranged in fixed positions within each of an upper, a central, and a lower section, vertically aligned one with another, and directly and concurrently responsive to a binary electronic character code, and a plurality of electrodes of said opposite polarity from among different sections are actuable in tandem in combinations corresponding to different alphabet characters, and said electrodes of said opposite polarity in said lower section are responsive only to character codes of lower case alphabet characters which have descenders.

11. A display according to claim 10 further comprising character code generating means for producing electronic codes for lower case English language alphabet characters, and means for enabling selected combinations of electrodes in said central and upper sections for illumination in patterns corresponding to ones of said lower case alphabet characters having ascending portions and for enabling selected combinations of electrodes in said central and lower sections for illumination in patterns corresponding to ones of said lower case alphabet characters having descending portions.

12. A display according to claim 11 further comprising an additional illuminable symbol for providing indications of correctness and incorrectness and including electrodes positioned to represent human facial features, at least some of which features are shaped in the form of alphabet characters.

* * * * *

UNITED STATES PATENT OFFICE

CERTIFICATE OF CORRECTION

Patent No. 4,237,459 Dated December 2, 1980

Inventor(s) JAMES CORDOVA

It is certified that error appears in the above-identified patent and that said Letters Patent are hereby corrected as shown below:

At column 10, line 16, delete the word "charicature" and substitute therefor --caricature--.

At column 11, claim 4, line 56, delete the word "rectalinear" and substitute therefor --rectilinear--.

At column 12, claim 7, line 12, delete the word "rectalinear" and substitute therefor --rectilinear--.

Signed and Sealed this

*Nineteenth* Day of *May 1981*

[SEAL]

*Attest:*

RENE D. TEGTMEYER

*Attesting Officer* *Acting Commissioner of Patents and Trademarks*